United States Patent [19]

Nakajima

[11] Patent Number: 4,704,885

[45] Date of Patent: Nov. 10, 1987

[54] APPARATUS FOR MAKING CONNECTING PIPES FOR CONNECTING DUCTS

[75] Inventor: Kenji Nakajima, Osaka, Japan

[73] Assignee: Ariyoshi Nakamura, Saitama, Japan

[21] Appl. No.: 906,575

[22] Filed: Sep. 9, 1986

Related U.S. Application Data

[62] Division of Ser. No. 836,515, Mar. 5, 1986, abandoned.

[30] Foreign Application Priority Data

Mar. 8, 1985 [JP] Japan ..... 60-47277
Dec. 13, 1985 [JP] Japan ..... 60-281599

[51] Int. Cl.[4] ..... B21C 37/12
[52] U.S. Cl. ..... 72/50
[58] Field of Search ..... 72/49, 50, 168, 169, 72/172, 368, 370

[56] References Cited

U.S. PATENT DOCUMENTS 189,267 4/1877 Rothan ..... 285/183
519,182 5/1894 Gould ..... 72/50
3,122,115 2/1964 Siegwart ..... 72/50
3,220,234 11/1965 Harper ..... 72/50
3,606,779 9/1971 Parma ..... 72/49
3,651,677 3/1972 Siegwart ..... 72/50
3,858,421 1/1975 Wood ..... 72/50

FOREIGN PATENT DOCUMENTS 681337 10/1952 United Kingdom ..... 72/50

*Primary Examiner*—E. Michael Combs
*Attorney, Agent, or Firm*—Wenderoth, Lind & Ponack

[57] ABSTRACT

A curved connecting pipe for ducts is proposed which can be manufactured at low cost. It is made by rolling spirally a long metal strip having wide portions and narrow portions alternately so that the wide portions will meet at one edge of the strip and the narrow portions will meet at the other edge. A single flange formed along one edge is received in a double flange formed along the other edge. An apparatus for making the connecting pipe is disclosed. In another embodiment, a flat edge of the strip is rested on a recessed edge and welded together.

3 Claims, 19 Drawing Figures

FIG. 1
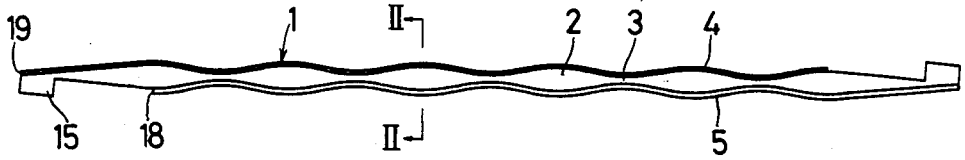
FIG. 2
FIG. 3
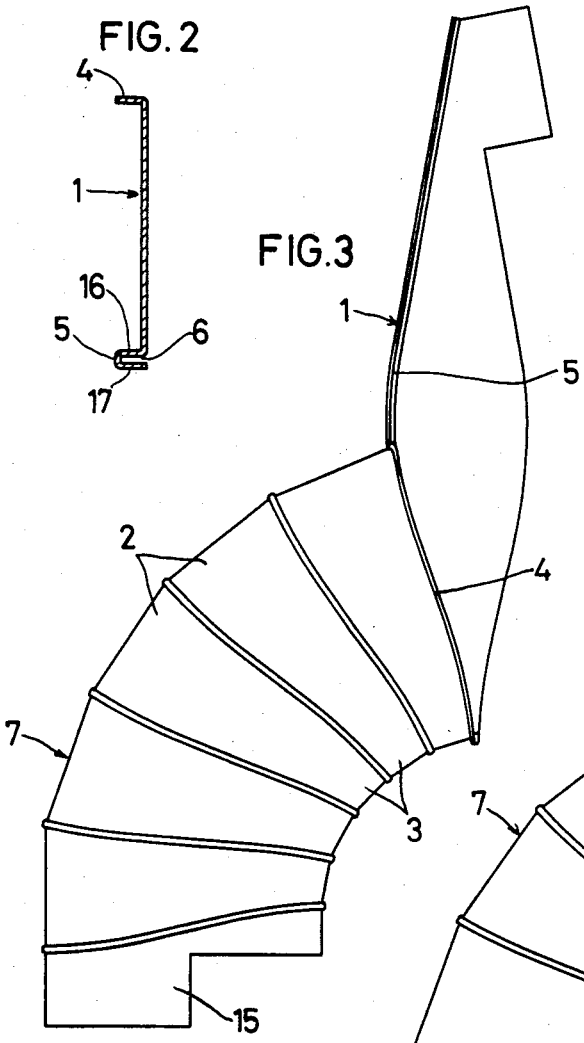
FIG. 4
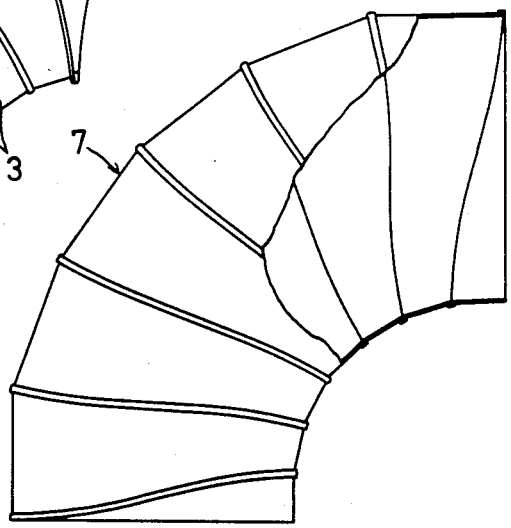

FIG.11
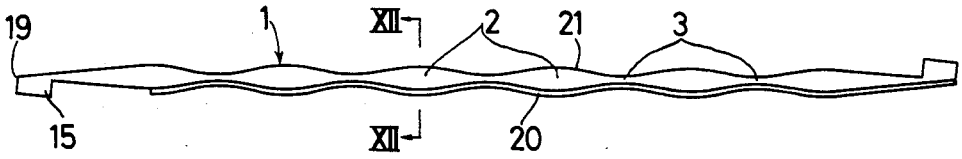
FIG.12
FIG.13
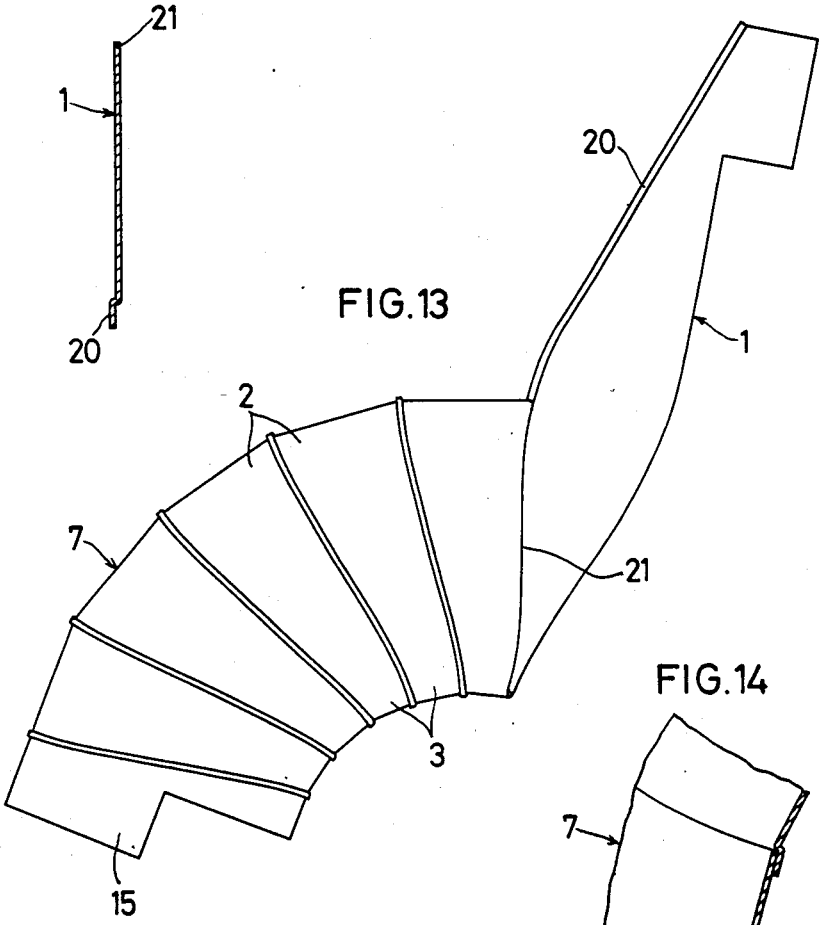
FIG.14
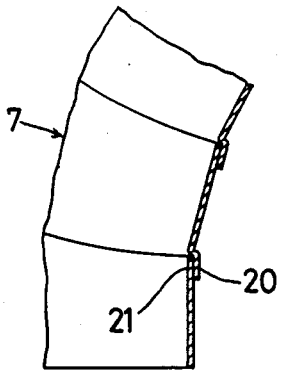

APPARATUS FOR MAKING CONNECTING PIPES FOR CONNECTING DUCTS

This is a division of application Ser. No. 836,515, filed Mar. 5, 1986 and now abandoned.

BACKGROUND OF THE INVENTION

The present invention relates to an apparatus for making connecting pipes for connecting ducts used in air conditioning systems, etc.

Although a conventional spiral pipe for connecting ducts made of aluminum and having corrugations for reinforcement has an advantage that it can be easily bent, it has a disadvantage in that the air flowing through it encounters remarkably large resistance and produces whistling sounds because of friction with the undulatory internal surface of the corrugations.

In order to eliminate the above-described disadvantage, it has been proposed to form an elbow type connecting pipe by rolling a plurality of strips cut from a flat iron plate into barrels. The barrels can then be welded together. However, this work has to be done by inefficient manual labor resulting in a high manufacturing cost.

SUMMARY OF THE INVENTION

It is an object of the present invention to provide an apparatus for making a curved connecting pipe for connecting ducts which can be carried which can manufacture the pipes more efficiently and at a much lower cost. The connecting pipe manufactured by the apparatus in accordance with the present invention is formed by spirally rolling a metal strip having wide portions and narrow portions alternately in such a manner that the wide portions will adjoin each other and the narrow portions will adjoin each other. In one embodiment of the present invention a pipe making apparatus is designed to make a pipe comprising a flange formed along one longitudinal edge of the strip substantially over the full length thereof, and a double flange is formed along the other longitudinal edge of the strip substantially over the full length thereof. When the apparatus rolls the strip spirally, the single flange is fitted into, and secured to, the double groove. Thus the metal strip is formed into an elbow pipe.

In another embodiment of the present invention a pipe making apparatus is designed to make a pipe comprising one longitudinal edge having a recessed portion so that, when the strip is spirally rolled by the apparatus, the edge not-recessed will be aligned with the recessed edge so that they can be welded.

With the above-described objects in view and as will become apparent from the following detailed description, the present invention will be more clearly understood in connection with the accompanying drawings.

BRIEF DESCRIPTION OF THE DRAWINGS

FIG. 1 is a plan view of a metal strip used made into a pipe by the first embodiment of the present invention;

FIG. 2 is an enlarged sectional view taken along line II—II of FIG. 1;

FIG. 3 is a front view of the metal strip which is spirally rolled to form a curved pipe by the apparatus of the present invention;

FIG. 4 is a front view of a finished product;

FIG. 11 is a plan view of a metal strip made into a pipe by the second embodiment of the present invention;

FIG. 12 is an enlarged sectional view taken along line XII—XII of FIG. 11;

FIG. 13 is a front view of the metal strip which is being spirally rolled by the second embodiment of the present invention;

FIG. 14 is an enlarged vertical section of a part of a finished product made by the second embodiment of the present invention;

FIG. 15 is a front view of the second embodiment of the present invention;

FIG. 16 is an enlarged view showing the operation of the electrode rollers used therein; and FIG. 17 is an enlarged view showing the operation of the press roller used therein.

DETAILED DESCRIPTION OF THE INVENTION

Figure 5:
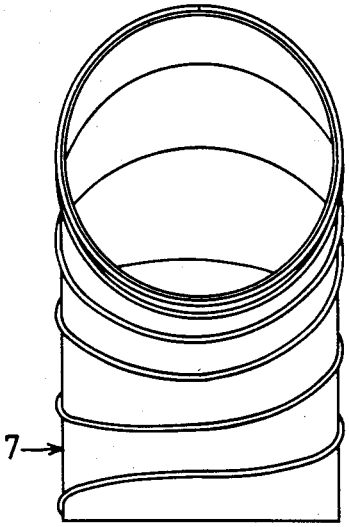
FIG. 5 is a right-hand side view thereof.

Referring now to FIG. 1, a metal strip 1 stamped out from a galvanized iron plate is an example of a material sufficient for making one curved connecting pipe in accordance with the present invention. The metal strip 1 has gently undulating longitudinal edges so that wide portions 2 will alternate with narrow portions 3.

In FIG. 1, a single flange 4 is provided along one longitudinal edge of the metal strip 1 substantially over the full length thereof, and a double flange 5 is provided along the other longitudinal edge of the metal strip 1 substantially over the full length thereof.(FIG. 2) Both the single flange and the double flange stand on the same side of the metal strip.

The double flange 5 is a longitudinal edge folded in two so as to have a space 6 (FIG. 2) between the basal portion 16 and the end portion 17. The space 6 is slightly wider than the thickness of the material so that the single flange 4 may be received in the space 6 when the metal strip 1 is spirally rolled by the present invention.

As shown in FIG. 3, the metal strip 1 is spirally rolled by the present invention in such a manner that all the wide portions 2 meet at one side of the pipe and all the narrow portions 3 meet at the diametrically opposite side thereof.

Figure 6:
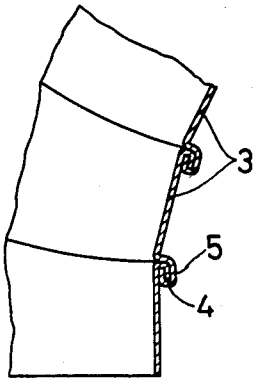
FIG. 6 is an enlarged vertical sectional view of a part thereof.

After the single flange 4 has been fitted into the space 6, the basal portion 16 and the end portion 17 are pressed toward each other and thrown down to the pipe as shown in FIG. 6 so that the connection in tightened and the single flange 4 from slipping out.

Figure 8A:
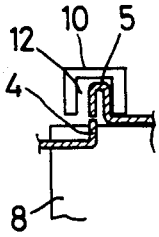
FIGS. 8*a* to 8*c* are enlarged vertical sectional views showing how the single-grooved edge of the strip is clamped in the double-grooved edge of the strip by the present invention.
Figure 8B:
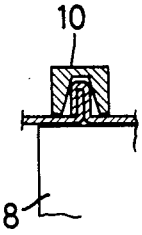
Figure 8C:
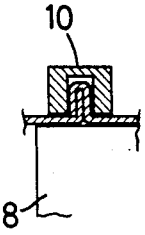
Figure 7:
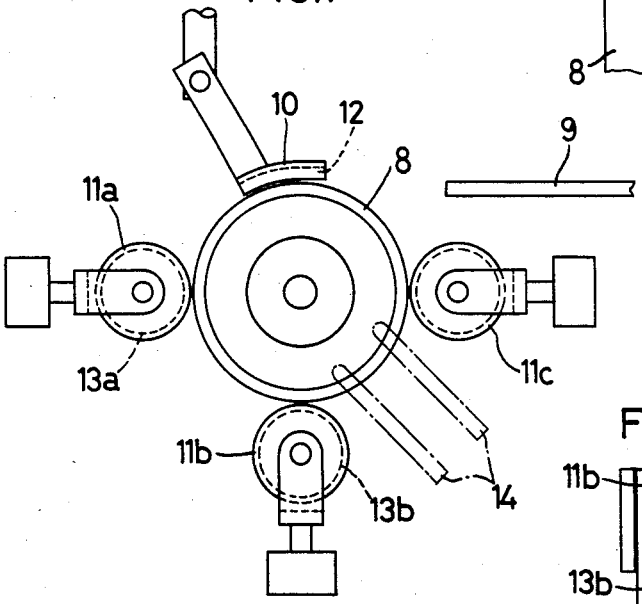
FIG. 7 is a front view of a first embodiment of an apparatus for manufacturing a pipe according to the present invention.

Referring now to FIG. 7, an apparatus for making a curved connecting pipe 7 according to the first embodiment of the present invention includes a drum 8 adapted to be rotated by a varying-speed motor (not shown), a horizontal guide plate 9 for feeding the metal strip 1 to the drum 8, a guide member 10 provided over and along the periphery of the drum 8, and press rollers 11*a*, 11*b* and 11c provided on the left, lower and right sides, respectively, of the periphery of the drum 8. The guide member 10 has a longitudinal groove at 12. The groove 12 is wide on the feed side as shown in FIG. 8a, and becomes gradually narrower toward the delivery side as shown in FIGS. 8b and 8c.

During the operation of this apparatus, the metal strip 1 is fed from the horizontal guide plate 9 tangentially to the periphery of the drum 8 with the leading end 18 (FIG. 1) of the double flange 5 received in the groove 12. When the strip has made one revolution around the drum 8, the end 19 of the single flange 4 is fed substantially right beneath the space 6 (FIG. 8a) of the double flange. As the drum 8 and the leading end of the strip further rotate, the latter is guided by the side wall of the groove 12 so as to fit into the space 6 midway between the feed and delivery sides of the groove 12. Because of the above-described configuration of the groove 12, the leading end 19 of the single flange 4 is firmly grasped by the double flange 5 when it is delivered from the delivery side of the groove 12. Such a firmly grasped condition is continuously effected as the succeeding portion of the single flange 4 is fitted into the space 6 in the double flange 5 and delivered from the delivery side of the groove 12.

Figure 9:
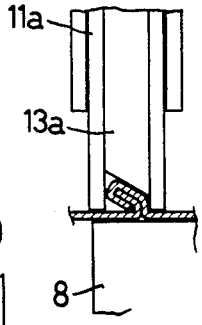
FIGS. 9 and 10 are enlarged views showing the operation of the press rollers used therein.

The single flange 4 grasped by the double flange 5 is then fed to the press roller 11a, the grooved rim of which has a beveled bottom 13a (FIG. 9) so as to incline the grasped edge.

Figure 10:
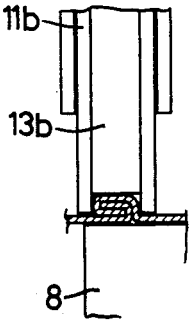

The flange-connected pipe is then fed to the press roller 11b, the rim of which has a shallow groove with a cylindrical bottom 13b (FIG. 10) so as to flatten the grasped edge to the metal strip 1.

The press roller 11c is grooved in the same manner as the press roller 11b. While the curved connecting pipe 7 is during the process of manufacture, the press roller 11c, together with the remaining two rollers, holds the pipe in place against the cylindrical surface of the drum 8.

When the curved connecting pipe 7 further increases in axial length, pipe supports 14 prevent the end of the curved connecting pipe 7 from being thrown about by centrifugal force. For this purpose, the pipe supports 14 are disposed near the end face of the drum 8 and are curved so as to be placed against the internal surfaces of the wide portions 2 of the curved connecting pipe 7.

A lug 15 is provided at the leading and trailing ends of the strip 1 for reinforcement and serves to prevent the leading end from warping when the single-flanged edge of the strip is pulled toward the double-flanged edge by the guide member 10.

In the second embodiment shown in FIG. 11, the metal strip 1 has a recessed portion 20 along one longitudinal edge of the strip 1 to make a lap joint with the other flat longitudinal edge portion 21. However, both of the edges may be even with the metal strip 1 to make a butt joint.

Referring now to FIGS. 15 to 17, an apparatus for making a curved connecting pipe 7 in the second embodiment of the present invention includes a drum 8, an electrode roller 22 mounted in the drum, another electrode 23 disposed over the drum, and three press rollers 11d with flat rims provided at the left, lower and right sides, respectively, of the drum 8.

In operation of this apparatus, the metal strip 1 is fed from the horizontal guide plate 9 tangentially to the periphery of the drum 8 in such a manner that, when the leading end (FIG. 11) of the strip has made one revolution around the drum 8, the end comes right beneath the recessed edge 20 so as to make a lap joint. As the drum 8 and the metal strip 1 further rotate, the lapped surfaces are subjected to seam weld between the electrode rollers 22 and 23.

In either of the two apparatuses shown in FIGS. 7 and 15, the leading end of the strip may be automatically guided so as to fit into the space 6 (FIG. 2) or come right beneath the recessed edge 20 (FIG. 12) when the end has made one revolution around the drum 8. The automatic guide means may comprise a motor-driven cam mechanism adapted to correct the position of the metal strip 1 either on the basis of data about the curvature of the longitudinal edges of the metal strip 1 or in response to an output signal from a sensor designed to detect any deviation of the flange on the strip wound around the drum from the flange on the strip which is to be fed to the roll.

The metal strip 1 may be formed by unfolding a long strip of rolled metal, stretching it out on the horizontal guide plate 9, and forming a single flange 4 or a double flange 5 or a recessed edge 20.

The curved connecting pipe in accordance with the present invention may be formed to have different diameters at their ends so that it can connect a duct having a large diameter to another duct having a small diameter.

The curved connecting pipe in accordance with the present invention has an advantage that it can be mass-produced at low cost.

What I claim is:

1. An apparatus for making a connecting pipe from a metal strip having undulating longitudinal edges, a single flange raised on the strip along one of said longitudinal edges and extending substantially along the full length thereof, a double flange comprising two flange portions extending along the other of said longitudinal edges and being raised along the same side of the strip as is the single flange, said two flange portions being spaced apart for forming a space therebetween open to the other side of the strip from which the flanges are raised, said apparatus comprising:

a drum for receiving the metal strip and over and around which the metal strip is wrapped with the longitudinal edges aligned so that the single flange extends into the space formed between the flange portions of the double flange for forming the connecting pipe;

a guide member having a longitudinal groove positioned adjacent a portion of the outer periphery of said drum, the guide groove of the guide member being positioned for initially receiving and guiding the double flange of the metal strip along the outer periphery of said drum and for receiving and guiding the double flange and the single flange extending into the space formed between the flange portions of the double flange after said strip is wrapped around said drum with the longitudinal edges aligned;

a guide plate adjacent the outer periphery of said drum and cooperating with said guide member for positioning the strip to be received by said drum tangentially to the outer periphery of said drum and for aligning the double flange of the strip with said groove in said guide member;

a first press roller positioned adjacent the outer periphery of said drum for receiving the double flange and the single flange extending into the space formed between the flange portions of the double flange after the same is received by said guide member, said roller having a hub having a tapered shape tapered in a direction parallel to the central axis thereof for bending the double flange and the single flange towards the metal strip; and a second press roller positioned adjacent the outer periphery of said drum for receiving the double flange and single flange extending into the space between the flange portions of the double flange after the same is received by said first press roller, said second press roller having a hub having a cylindrical shape for further bending the double flange and the single flange bent by the first press roller so that the single flange and the flange portions of the double flange lie substantially flat on the metal strip.

2. An apparatus as claimed in claim 1 wherein, said first press roller further comprises a pair of parallel flanges each of which is integral with and disposed on a respective side of said tapered hub and between which said double flange and said single flange is bent by said tapered hub; and said second press roller further comprises a pair of parallel flanges each of which is integral with and disposed on a respective side of said cylindrical hub and between which said double flange and said single flange are further bent by said cylindrical hub.

3. An apparatus for making a connecting pipe from a metal strip having undulating longitudinal edges, a single flange raised on the strip along one of said longitudinal edges and extending substantially along the full length thereof, a double flange comprising two flange portions extending along the other of said longitudinal edges and being raised along the same side of the strip as is the single flange, said two flange portions being spaced apart for forming a space therebetween open to the other side of the strip from which the flanges are raised, said apparatus comprising:

a drum for receiving the metal strip and over and around which the metal strip is wrapped with the longitudinal edges aligned so that the single flange extends into the space formed between the flange portions of the double flange for forming the connecting pipe;

a guide member having a longitudinal groove positioned adjacent a portion of the outer periphery of said drum, the guide groove of the guide member being positioned for initially receiving and guiding the double flange of the metal strip along the outer periphery of said drum and for receiving and guiding the double flange and the single flange extending into the space formed between the flange portions of the double flange after said strip is wrapped around said drum with the longitudinal edges aligned;

a guide plate adjacent the outer periphery of said drum and cooperating with said guide member for positioning the strip to be received by said drum tangentially to the outer periphery of said drum and for aligning the double flange of the strip with said groove in said guide member, said groove of said guide member having a feed side facing said guide plate and a delivery side opposite said feed side, and said groove having a width as measured in a direction extending parallel to the central axis of the drum that tapers from said feed side toward said delivery side; and a first press roller positioned adjacent the outer periphery of said drum for receiving the double flange and the single flange extending into the space formed between the flange portions of the double flange after the same is received by said guide member, said roller having a hub having a tapered shape tapered in a direction parallel to the central axis thereof for bending the double flange and the single flange towards the metal strip; and a second press roller positioned adjacent the outer periphery of said drum for receiving the double flange and single flange extending into the space between the flange portions of the double flange after the same is received by said first press roller, said second press roller having a hub having a cylindrical shape for further bending the double flange and the single flange bent by the first press roller so that the single flange and the flange portions of the double flange lie substantially flat on the metal strip.

* * * * *